United States Patent [19]

Bucher

[11] Patent Number: 4,625,715

[45] Date of Patent: Dec. 2, 1986

[54] WHIRLPOOL BATH MASSAGING APPARATUS

[75] Inventor: Heinz Bucher, Rottweil, Fed. Rep. of Germany

[73] Assignee: Metronic Electronic GmbH, Fed. Rep. of Germany

[21] Appl. No.: 577,043

[22] Filed: Feb. 6, 1984

[30] Foreign Application Priority Data

Feb. 18, 1983 [DE] Fed. Rep. of Germany ..... 3305576

[51] Int. Cl.[4] ..... B01F 3/04

[52] U.S. Cl. ..... 128/66; 4/543; 4/581; 261/122; 261/124

[58] Field of Search ..... 128/66, 65; 4/581, 541, 4/543; 261/122, 124, DIG. 26

[56] References Cited

U.S. PATENT DOCUMENTS

| | | | |
|---|---|---|---|
| 4,048,266 | 9/1977 | Baumann | 128/66 |
| 4,122,846 | 10/1978 | Baumann | 128/66 |
| 4,269,797 | 5/1981 | Mikiya et al. | 4/543 |
| 4,430,762 | 2/1984 | Marshall | 128/66 |

FOREIGN PATENT DOCUMENTS

| | | | |
|---|---|---|---|
| 1133077 | 7/1962 | Fed. Rep. of Germany | 128/66 |
| 1262508 | 3/1968 | Fed. Rep. of Germany | 128/66 |
| 2161925 | 5/1973 | Fed. Rep. of Germany | 128/66 |
| 2202014 | 7/1973 | Fed. Rep. of Germany | 128/66 |
| 2451503 | 6/1976 | Fed. Rep. of Germany | 128/66 |
| 2509974 | 9/1976 | Fed. Rep. of Germany | 128/66 |
| 2517365 | 10/1976 | Fed. Rep. of Germany | 128/66 |
| 2436796 | 12/1977 | Fed. Rep. of Germany | 128/66 |
| 2647793 | 4/1978 | Fed. Rep. of Germany | 128/66 |
| 2729198 | 8/1978 | Fed. Rep. of Germany | 128/66 |
| 2804966 | 10/1979 | Fed. Rep. of Germany | 128/66 |

*Primary Examiner*—Gene Mancene
*Assistant Examiner*—J. Hakomaki
*Attorney, Agent, or Firm*—Thomas W. Speckman

[57] ABSTRACT

A whirlpool bath massaging apparatus having a bubble mat, a distributor having a control switch for regulating the air supply, and control means including a blower which is in communication with the bubble mat through an aerator tube and the distributor. The distributor is in the form of a self-contained structural unit separate from the bubble mat and is provided with inlet connecting means for the aerator tube and with outlet connecting means in the form of connector studs equal in number as there are partial sections of the bubble mat. The distributor with the control switch thereon forms an insertable unit which is installed in a receptacle provided in the bubble mat, whereby connector studs are directly plugged into sockets provided in the receptacle and in communication to the partial sections of the bubble mat. The distributor/control switch unit constitutes an easily exchangeable, inexpensive replacement part.

15 Claims, 4 Drawing Figures

WHIRLPOOL BATH MASSAGING APPARATUS

BACKGROUND OF THE INVENTION

1. Field of the Invention

This invention relates to a whirlpool bath massaging apparatus comprising a bubble mat, a distributor having a control switch for regulating the air supply, and control means including a blower which is in communication with the bubble mat by way of an aerator tube and the distributor. The distributor is in the form of a self-contained structural unit separate from the bubble mat and is provided with inlet connecting means for the aerator tube and with outlet connecting means in the shape of connector studs of equal number as there are partial sections in the bubble mat.

2. Description of the Prior Art

A whirlpool massaging apparatus of this general type is disclosed in German Patent Publication DE-AS No. 27 29 198. In this prior whirlpool massager, the distributor including the control switch is disposed outside the bathtub. The distributor must therefore be connected to the bubble mat placed in the bathtub by a plurality of connecting hoses. If the bubble mat is comprised of a plurality of individually operative partial sections, the number of connecting hoses between the distributor and the bubble mat in the bathtub must equal the number of such operative partial mat sections. This multiplicity of connecting hoses is an obstacle to the use of the bubble mat having the various hoses connected to it. Furthermore, it is difficult to conveniently operate the distributor because the distributor is floatingly suspended between the aerator tube coming from the control unit and the various connecting hoses so that it fails to maintain a steady defined position with respect to the bubble mat.

From German Patent Publication DE-OS No. 25 17 365 it is also known to integrate the distributor into the bubble mat. For this purpose, a head section is provided separately from the other partial sections of the bubble mat. The head section has a built-in control member which is fixedly connected to the other mat sections. In this prior whirlpool massager, the distributor including the control switch is placed in the water-filled tub together with the bubble mat. Since the water temperature varies with the preferences of the user of the wirlpool bath massager, the control member of the distributor is exposed to corresponding temperature fluctuations which in time may lead to leaks, especially in the control member. Replacement of the control member, or the entire head section, respectively, requires substantial work.

SUMMARY OF THE INVENTION

It is the object of the present invention to provide a whirlpool bath massaging apparatus of the type referred to in the introductory paragraph above, in which the distributor control including the control switch has the form of a separate structural unit which is attachable to the bubble mat without the use of connecting hoses in a manner that it can be quickly and easily replaced.

This is accomplished according to the invention in that the bubble mat is provided at one end with a receptacle for the positive insertion of the distributor control, that this receptacle has disposed therein the inlet connecting means in the form of sockets associated with the partial sections of the bubble mat, and that the connector studs of the distributor control are adapted to be directly inserted into such sockets and closely retained therein as the distributor control is placed into the receptacle in the bubble mat.

The structural unit comprising the distributor control member need only be inserted into the receptacle provided for it in the bubble mat and the requisite connection to the partial sections of the bubble mat is instantly established. The aerator tube coming from the regulator need only be inserted into the socket provided for it on the distributor control. Thus, the distributor control member represents a small structural unit which is capable of being replaced by a lay person. The distributor control, being subject to a certain amount of wear and deterioration due to aging, can therefore be made available as a simple and inexpensive replacement part.

According to one embodiment of the invention, the distributor control has a housing with a lower portion and an upper portion. The underside of the lower housing portion has formed thereon vertically extending connector studs. The upper housing portion has formed thereon a sleeve serving as a connecting socket for the aerator tube. The connecting socket projects into the space formed between the lower housing portion and the upper housing portion, establishing communication with that space. Thus, the connecting fittings between the distributor control and the bubble mat are covered and only the receiving socket for the aerator tube remains exposed.

The selective covering and uncovering of the connector studs on the distributor control for the partial sections of the bubble mat is achieved according to another embodiment of the invention, in that the connector studs of the distributor control are in communication with the space between the lower housing portion and the upper housing portion and may be selectively covered by a cover plate. The cover plate is disposed between the lower housing portion and the upper housing portion and is rotatable by means of a control switch which is mounted in a sleeve-like fitting in a bearing sleeve provided in the upper housing portion.

The rotatable mounting of the cover plate and its non-rotatable coupling to the control switch disposed outside the housing are attained according to another embodiment in that the cover plate has formed thereon a bearing sleeve for receiving the bearing sleeve of the upper housing portion and is adapted to be rotatable about it, that the bearing sleeve of the cover plate has a bottom section at the end facing the lower housing portion which has an aperture therein to admit a mounting projection of the control switch, and that this mounting projection is rotatably fitted in a bearing on the lower housing portion and is nonrotatably mounted in the bottom of the bearing sleeve of the cover plate.

The sealing in the area of the control switch and the housing is attained in that the sleeve-shaped mounting projection on the control switch and the bearing of the upper housing portion are sealed off from each other by a washer.

The secure mounting of the control switch in the housing of the distributor control is achieved according to another embodiment of the invention in that the mounting projection on the control switch is formed by two latch springs diametrically arranged to each other and extending with one latch member behind the bottom of the bearing sleeve of the control switch.

In order for the rotatable cover plate to securely close off the connector studs for the partial sections of the bubble mat, another embodiment provides for the connector studs to terminate flush with the inner side of the lower housing portion facing the upper housing portion, and that the cover plate is in snug engagement with the inner side of the lower housing portion and forces against integrally formed resilient projections against the inner side of the upper housing portion facing the lower housing portion.

A particularly simple embodiment of a bubble mat for two air distribution systems having differently sized nozzles is characterized in that the distributor has two connector studs, and the control switch is disposed in a recess provided in the upper surface of the upper housing portion and is adjustable until it comes to rest against the walls of this recess.

To safeguard against any disruption in the connection with the interior of the distributor control housing as the connector stud of the aerator tube coming from the regulator is inserted into the socket of the distributor, the end of the socket facing the lower housing portion merges through a ring-shaped end wall into a centering sleeve extending into the socket. The space between the socket and the centering bushing is greater than the wall thickness of a connector stud of the aerator tube insertable into the socket.

To keep the distributor control housing including the control switch as small as possible, another embodiment provides that the distributor control housing is arch-shaped in cross section, that the socket is disposed in the base area of the upper housing portion in which the lower housing portion has a section of greatest depth, that the rotatable mounting location of the cover plate is in a section of medium depth of the lower housing portion, that the connector studs and the cover plate are disposed in a section of smallest depth of the lower housing portion, and that the receptacle in the bubble mat is provided with sections conforming to the graduated sections of the lower housing portion of the distributor control. The appropriately stepped sections of the receptacle in the bubble mat permit a positive installation of the distributor with an expansive abutting action.

BRIEF DESCRIPTION OF THE DRAWING

The invention will be described in more detail with reference to a representative embodiment illustrated in the drawings, in which.

DESCRIPTION OF PREFERRED EMBODIMENTS

Figure 1:
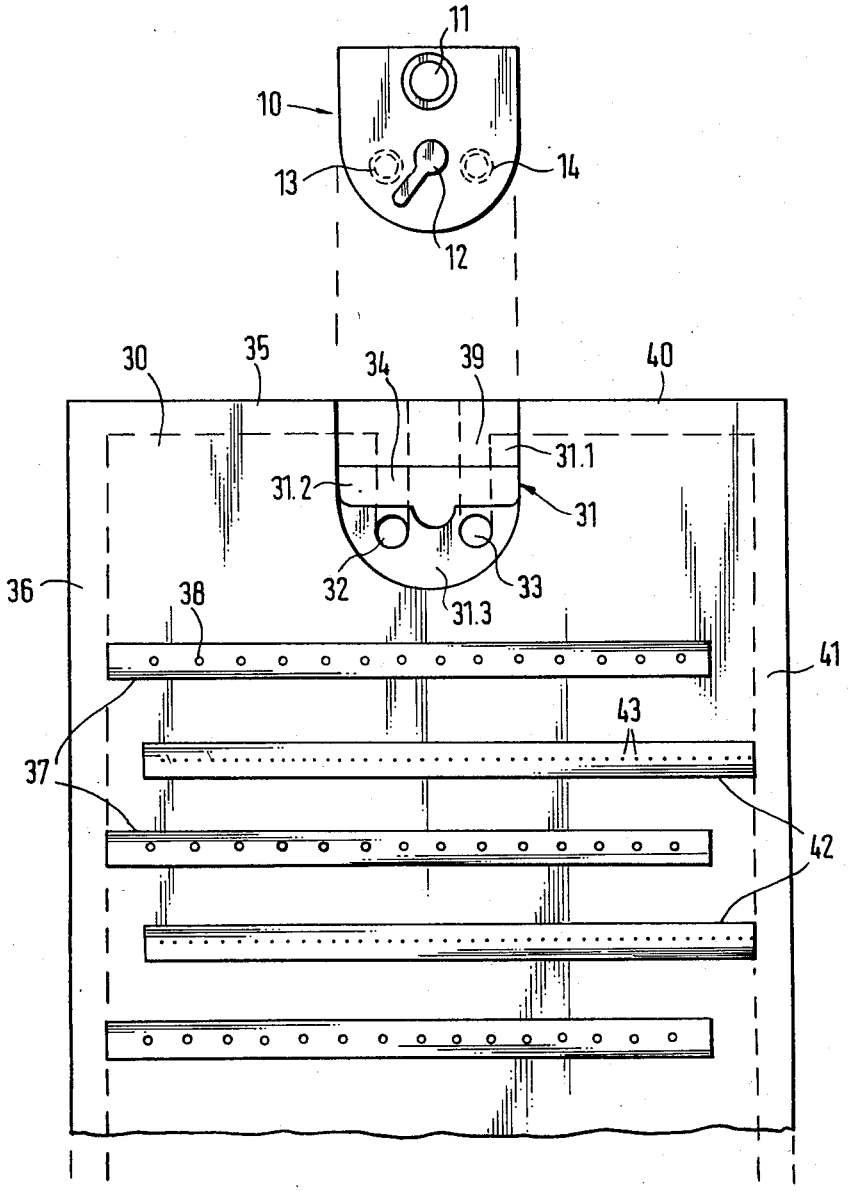
FIG. 1 illustrates diagrammatically a separate insertable structural unit comprising the distributor control with the control switch, and the adjacent end of a bubble mat having a corresponding receptacle for the distributor.

In FIG. 1, distributor control 10 is shown as an individual structural unit, separate from bubble mat 30. On the upper surface of distributor control 10, near the base of the arch-shaped cross-sectional area, socket 11 is provided to receive the aerator tube coming from the regulator. Projecting from the underside of distributor control 10 are two connector studs 13 and 14 which are selectively connectible to socket 11 by means of a control member. Serving to operate the control member is control switch 12 provided on the top surface of distributor control 10 and thus easily accessible.

The end of bubble mat 30 shown in FIG. 1 is provided with receptacle 31 for holding distributor control 10 in a close fit. Bubble mat 30 may take any other convenient shape, however. Distributor control 10 is installed in receptacle 31 from the top, whereby connector studs 13 and 14 are inserted into sockets 32 and 33 which are associated with the two air distribution systems of bubble mat 30. Connector studs 13 and 14 are closely held in sockets 32 and 33 which may be accomplished simply by an appropriate press or compression fit. Connector studs 13 and 14 or sockets 32 and 33 may additionally be provided with a washer.

Figure 2:
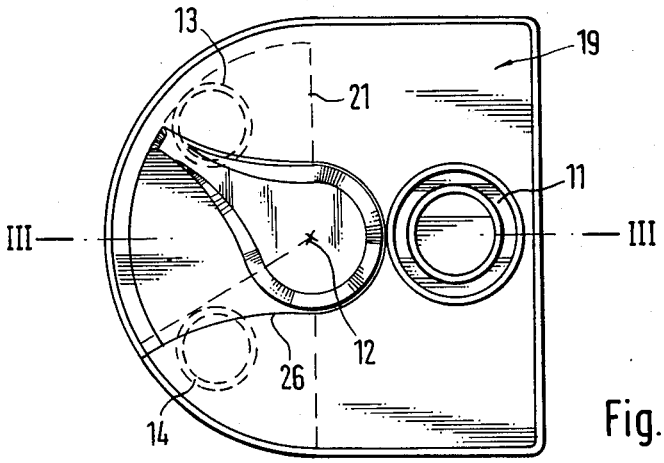
FIG. 2 is a top plan view of an embodiment of a distributor control with control switch.
Figure 3:
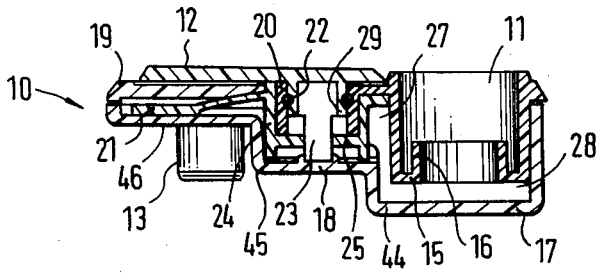
FIG. 3 is a sectional view of the distributor of FIG. 2, taken along the line III—III.
Figure 4:
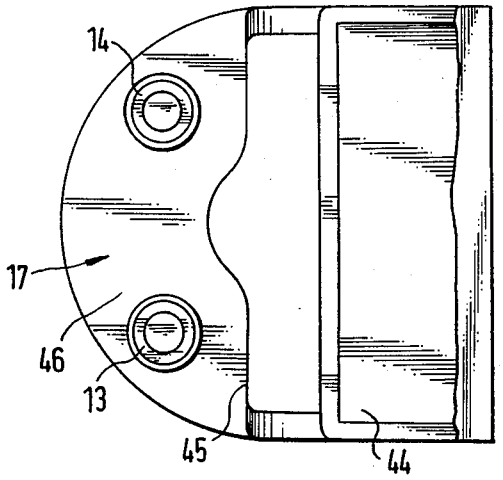
FIG. 4 is a bottom plan view of the distributor control and control switch of FIG. 2.

Sections 31.1, 31.2 and 31.3 of receptacle 31 have different depths and conform to corresponding sections 44, 45 and 46 of bottom portion 17 of distributor control 10 as shown in FIGS. 2 through 4.

Socket 32 is in communication through air channels 34, 35 and 36 with distributor channels 37 having large air outlets 38. Distributor channels 37 branch off from air channel 36 which extends along one of the longitudinal edges of bubble mat 30. Socket 33 is in communication through air channels 39, 40 and 41 with distributor channels 42 featuring pearl or fine air outlets 43. Distributor channels 42 branch off from air channel 41 and are between distributor channels 37. Distributor channels 37 and 42 extend transverse to the longitudinal dimension of bubble mat 30. Bubble mat 30 may consist of a plurality of sections disposed one after the other in the longitudinal direction. The various mat sections may be joined to one another and extend air channels 36 and 41 running along the longitudinal edges of the mat.

The construction of distributor control 10 including the control switch is illustrated in FIGS. 2 to 4. Since the small size of the structural unit is at a premium, the unit is made up of simple component parts so that it can be made readily available as an inexpensive replacement part. The housing of distributor control 10 comprises lower or bottom portion 17 and upper or top portion 19. The lower portion is provided with three stepped sections 44, 45 and 46, affording varying depths for the housing. In the area of section 44, upper housing portion 19 has molded therein receptacle 11 in the form of a socket which extends into space 28 formed between bottom portion 17 and top portion 19 of the housing and communicating with such space. The end of socket 11 facing bottom portion 17 terminates short of bottom portion 17 and is provided with an annular terminal wall or rim 15 which merges with centering bushing 16 concentrically inserted in socket 11. Thereby the inserted connector stud of the aerator tube coming from the regulator is prevented from disrupting communication with space 28.

Disposed in offset section 45 of bottom portion 17 is bearing 18 for fitting 23 projecting from control switch 12. Offset section 46 carries two connector studs 13 and 14. Disposed at offset section 46, in the small space between bottom portion 17 and top housing portion 19 is cover plate 21 which is in close engagement with the inner side of bottom portion 17, bracing against resilient projections, not illustrated, which are formed on the inner side of top portion 19. Cover plate 21 thus permits one to selectively inactivate connector studs 13 and 14, which terminate flush with cover plate 21, so that they are shut off from communication with spaces 27 and 28.

To accomplish this mechanically, cover plate 21 must be rotated, as is shown in FIG. 2. In the position illustrated, connector stud 13 is covered up while connector stud 14 is exposed. Control switch 12 in recess 26 provided in upper housing portion 19 is moved until it abuts the wall of recess 26. Turning control switch 12 of FIG. 2 counterclockwise until it abuts the lower wall of recess 26 causes cover plate 21 to expose connector stud 13 and to cover connector stud 14. In order for cover plate 21 to rotate along with control switch 12, a non-rotatable coupling between these two parts is required. Cover plate 21 has formed thereon bearing sleeve 24 the bottom 25 of which, facing lower housing portion 17, is provided with an aperture to admit fitting 23 projecting from control switch 12. Coupling between control switch 12 and cover plate 21 is established when fitting 23 is rotatably inserted in the aperture in bottom 25 of bearing sleeve 24. Bearing sleeve 24 of cover plate 21 receives bearing sleeve 20 formed on upper housing portion 19 and is rotatable about it. Formed on control switch 12 is sleeve-shaped projection 29 which is rotatably inserted into bearing sleeve 20 of upper housing portion 19. Fitting 23 of control switch 12 may be divided into two diametrically arranged latch springs extending behind bottom 25 of bearing sleeve 24 of cover plate 21, with the result that control switch 12 is securely held to cover plate 21 which itself, in turn, is retained in the housing by bearing sleeve 20 of upper housing portion 19. Inserted between fitting 29 of control switch 12 and bearing sleeve 20 of upper housing portion 19 is washer 22 for sealing off the housing in the area of this rotary mounting assembly.

In the illustrated embodiment, control switch 12 is movable into two defined terminal positions, thereby selectively exposing one or the other of the two connector studs 13 or 14 to enable the exposed connector stud to communicate through spaces 27 and 28 with socket 11. It is also possible, however, to provide more than two defined control positions for control switch 12 to activate or deactivate, respectively, more than two connector studs in various combinations. In such case, receptacle 31 in bubble mat 30 is provided with the corresponding number and arrangement of sockets required for the connector studs of distributor control 10.

I claim:

1. Whirlpool bath massaging apparatus comprising a bubble mat having a plurality of separated air distribution channels and at least one air distribution system, a distributor control means having a control switch for regulating air supply to said at least one air distribution system, and an air supply means comprising a blower in communication with said bubble mat through an aerator tube and said distributor controls means, said distributor control means comprising a self-contained, removable structural unit separate from said bubble mat and insertable into a receptacle in said bubble mat, said distributor control means having a housing comprising a lower portion (17) and an upper portion (19), said upper housing portion (19) having formed thereon a sleeve connecting socket (11) for connection to said aerator tube, said lower housing portion (17) having outlet connecting means on its underside in the form of extending connector studs (13, 14) equal in number to said at least one air distribution system in said bubble mat, said connecting socket (11) projecting into spaces (27, 28) formed between said lower housing portion (17) and said upper housing portion (19) establishing an air passageway from said aerator tube to said connector studs (13, 14), said receptacle (31) of said bubble mat (30) conforming to the contours of said distributor control means (10) for positive installation of said distributor control means (10) in said bubble mat (30), said receptacle (31) having disposed therein inlet connecting means in the form of sockets (32, 33) associated with said at least one air distribution system, said connector studs (13, 14) of said distributor control means (10) being directly insertable into said sockets (32, 33) in communication with said at least one air distribution system and closely retained therein when said distributor control means (10) is retained in said receptacle (31) of said bubble mat (30), establishing an air passageway from said aerator tube to said at least one air distribution system.

2. Whirlpool bath massaging apparatus according to claim 1, characterized in that said connector studs (13, 14) of said distributor control means (10) are in communication with space (27, 28) between lower housing portion (17) and upper housing portion (19) and are adapted to be selectively covered by a cover plate (21) which is disposed between said lower housing portion (17) and said upper housing portion (19) and is rotatable by means of a control switch (12) which is mounted in a sleeve fitting (29) in a bearing sleeve (20) provided in said upper housing portion (19).

3. Whirlpool bath massaging apparatus according to claim 2, characterized in that said cover plate (21) has formed thereon a bearing sleeve (24) for receiving said bearing sleeve (20) in said upper housing portion (19) therein and is adapted to be rotatable about it, that bearing sleeve (24) of said cover plate (21) has bottom (25) at the end facing said lower housing portion (17), said bottom (25) is provided with an aperture to admit fitting (23) projecting from said control switch (12), and that said fitting (23) is rotatable in a bearing (18) on said lower housing portion (17) and is non-rotatably mounted in said bottom (25) of said bearing sleeve (24) of said cover plate (21).

4. Whirlpool bath massaging apparatus according to claim 3 characterized in that said fitting (23) of said control switch (12) comprises two latch springs diametrically arranged to each other and extending with one latch member behind said bottom (25) of said bearing sleeve (24) of said control switch (12) securely holding said control switch (12) to said cover plate (21).

5. Whirlpool bath massaging apparatus according to claim 2, characterized in that said fitting (23) of said control switch (12) comprises two latch springs diametrically arranged to each other and extending with one latch member behind said bottom (25) of said bearing sleeve (24) of said control switch (12) securely holding said control switch (12) to said cover plate (21).

6. Whirlpool bath massaging apparatus according to claim 2, characterized in that said sleeve fitting (29) of said control switch (12) and said bearing (20) of said upper housing portion (19) are sealed by washer (22).

7. Whirlpool bath massaging apparatus according to claim 6, characterized in that said fitting (23) of said control switch (12) comprises two latch springs diametrically arranged to each other and extending with one latch member behind said bottom (25) of said bearing sleeve (24) of said control switch (12) securely holding said control switch (12) to said cover plate (21).

8. Whirlpool bath massaging apparatus according to claim 5, characterized in that said connector studs (13,

14) terminate flush with the inner side of said lower housing portion (17) facing said upper housing portion (19), and that said cover plate (21) is in tight engagement with the inner side of said lower housing portion (17) and braces with integrally formed resilient projections against the inner side of said upper housing portion (19) facing said lower housing portion (17).

9. Whirlpool bath massaging apparatus according to claim 2, characterized in that said connector studs (13, 14) terminate flush with the inner side of said lower housing portion (17) facing said upper housing portion (19), and that said cover plate (21) is in tight engagement with the inner side of said lower housing portion (17) and braces with integrally formed resilient projections against the inner side of said upper housing portion (19) facing said lower housing portion (17).

10. Whirlpool bath massaging apparatus according to claim 9, characterized in that said control switch (12) is disposed in a recess (26) provided in the top surface of said upper housing portion (19) and is adjustable until stopped by the walls of said recess (26).

11. Whirlpool bath massaging apparatus according to claim 2, characterized in that said control switch (12) is disposed in a recess (26) provided in the top surface of said upper housing portion (19) and is adjustable until stopped by the walls of said recess (26).

12. Whirlpool bath massaging apparatus according to claim 1, characterized in that the end of said connecting socket (11) facing said lower housing portion (17) merges by way of a ring-shaped end wall (15) into a centering sleeve (16) extending into said socket (11), and that the space between said socket (11) and said centering sleeve (16) is greater than the wall thickness of an aerator tube connector stud insertable into said socket (11).

13. Whirlpool bath massaging apparatus according to claim 10, characterized in that the end of said connecting socket (11) facing said lower housing portion (17) merges by way of a ring-shaped end wall (15) into a centering sleeve (16) extending into said socket (11), and that the space between said socket (11) and said centering sleeve (16) is greater than the wall thickness of an aerator tube connector stud insertable into said socket (11).

14. Whirlpool bath massaging apparatus according to claim 13, characterized in that the housing of said distributor control means (10) is arch-shaped in cross section, that said socket (11) is disposed in the base area of an upper housing portion (19) in which a lower housing portion (17) has an offset section (44) of greatest depth, that the rotatable mounting location of the cover plate (21) is in an offset section (45) of medium depth of said lower housing portion (17), that said connector studs (13, 14) and said cover plate (21) are disposed in an offset section (46) of smallest depth of said lower housing portion (17), and that said receptacle (31) in said bubble mat (30) is provided with recessed sections (31.1, 31.2, 31.3) conforming to said series of offset sections (44, 45, 46) of said lower housing portion (17) of said distributor (10).

15. Whirlpool bath massaging apparatus according to claim 1, characterized in that the housing of said distributor control means (10) is arch-shaped in cross section, that said socket (11) is disposed in the base area of an upper housing portion (19) in which a lower housing portion (17) has an offset section (44) of greatest depth, that the rotatable mounting location of the cover plate (21) is in an offset section (45) of medium depth of said lower housing portion (17), that said connector studs (13, 14) and said cover plate (21) are disposed in an offset section (46) of smallest depth of said lower housing portion (17), and that said receptacle (31) in said bubble mat (30) is provided with recessed sections (31.1, 31.2, 31.3) conforming to said series of offset sections (44, 45, 46) of said lower housing portion (17) of said distributor (10).

* * * * *